US007849562B2

(12) United States Patent
Göranson et al.

(10) Patent No.: US 7,849,562 B2
(45) Date of Patent: Dec. 14, 2010

(54) DEVICE FOR A SCREEN

(76) Inventors: Dag Göranson, Vikingagatan 11, S-311 32, Falkenberg (SE); Örjan Göranson, Thomas Thorilds väg 3, S-311 40, Falkenberg (SE)

( * ) Notice: Subject to any disclaimer, the term of this patent is extended or adjusted under 35 U.S.C. 154(b) by 320 days.

(21) Appl. No.: 11/578,776

(22) PCT Filed: Apr. 27, 2005

(86) PCT No.: PCT/SE2005/000618

§ 371 (c)(1),
(2), (4) Date: Oct. 18, 2006

(87) PCT Pub. No.: WO2005/106172

PCT Pub. Date: Nov. 10, 2005

(65) Prior Publication Data

US 2008/0172837 A1 Jul. 24, 2008

(30) Foreign Application Priority Data

May 5, 2004 (SE) ..... 0401171

(51) Int. Cl.
*E05D 11/10* (2006.01)

(52) U.S. Cl. ..... 16/319; 16/342; 160/135; 160/351

(58) Field of Classification Search ..... 16/319, 16/337, 342, 341, 50; 160/135, 351
See application file for complete search history.

(56) References Cited

U.S. PATENT DOCUMENTS

| | | | | |
|---|---|---|---|---|
| 3,735,794 | A | 5/1973 | Ledowitz | |
| 5,881,789 | A * | 3/1999 | Melashenko et al. | 160/135 |
| 6,257,559 | B1 * | 7/2001 | Mouri | 256/26 |
| 6,293,328 | B1 * | 9/2001 | Fremont | 160/135 |

FOREIGN PATENT DOCUMENTS

| | | |
|---|---|---|
| DE | 440 210 | 1/1927 |
| DE | 299 18 337 | 4/2001 |
| DE | 200 05 688 | 9/2001 |
| FR | 2 799 492 | 4/2001 |

OTHER PUBLICATIONS

International Search Report dated Jul. 4, 2005.

* cited by examiner

*Primary Examiner*—William L. Miller
(74) *Attorney, Agent, or Firm*—McGinn IP Law Group, PLLC

(57) ABSTRACT

An arrangement in a screen for substantially continuous adjustability and parking of the screen in a desired position, including an upper hinge and a lower hinge. The lower hinge includes a conical element for achieving a braking effect against pivoting of the parts in relation to one another.

19 Claims, 4 Drawing Sheets

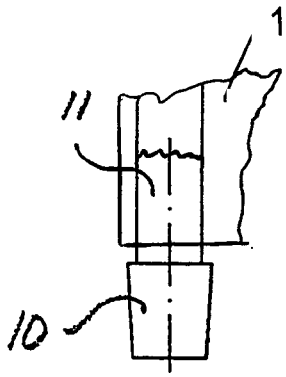
Fig 9
Fig. 10
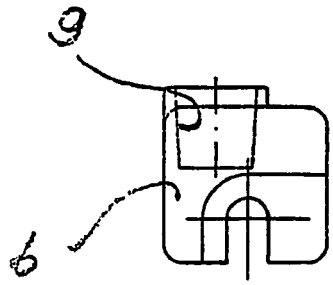
Fig 11
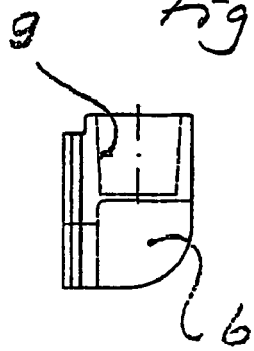
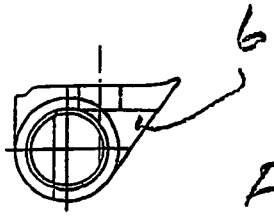
Fig 12

DEVICE FOR A SCREEN

BACKGROUND OF THE INVENTION

Field of the Invention

The present invention relates to an arrangement for substantially continuous adjustability and parking of the screen in the desired position.

An arrangement of the above-mentioned type is particularly usable in mobile screens that are exemplified in Swedish Registered Design 69367 which shows a fixed screen on a wheeled frame and two pivotal screens or screen parts on either side thereof. The prior art pivots or hinges have proved to suffer from various drawbacks, for example numerous moving parts that are excessively expensive, suffer from defective service life, etc. There is thus a need in the art for an improved hinge which is more economical and displays considerably longer service life, in particular from the functional viewpoint.

BRIEF SUMMARY OF THE INVENTION

Thus, the task forming the basis of the present invention is to satisfy the above-outlined needs.

This task is solved by the present invention in the arrangement disclosed by way of introduction in that it has been given the characterizing features as set forth below.

The present invention realises a hinge with a desirable braking function which moreover may be selected in a simple manner and thereby be adapted to different desirable conditions. After the selected braking function, this will, in principle, be constant and need not be adjusted while being used. Further, the constant braking effect will, in principle. be self-adjusting. A plurality of the parts included in the hinge entails simple assembly and thereby lower cost. Moreover, the present invention makes for superior design and hygienic form, which is of particular importance in the use of the product in the medical care sector and the like.

BRIEF DESCRIPTION OF THE DRAWINGS

The present invention will be described in greater detail hereinbelow with reference to the accompanying drawings.

FIG. 9 is a view of a part of the lower hinge section of the arrangement according to the present invention.

FIG. 10 is a front elevation of another part of the lower hinge section of the arrangement according to the present invention.

FIG. 11 is a side elevation of the part according to FIG. 10.

FIG. 12 is a top plan view of the part according to FIGS. 10 and 11.

DETAILED DESCRIPTION OF THE INVENTION

Figure 1:
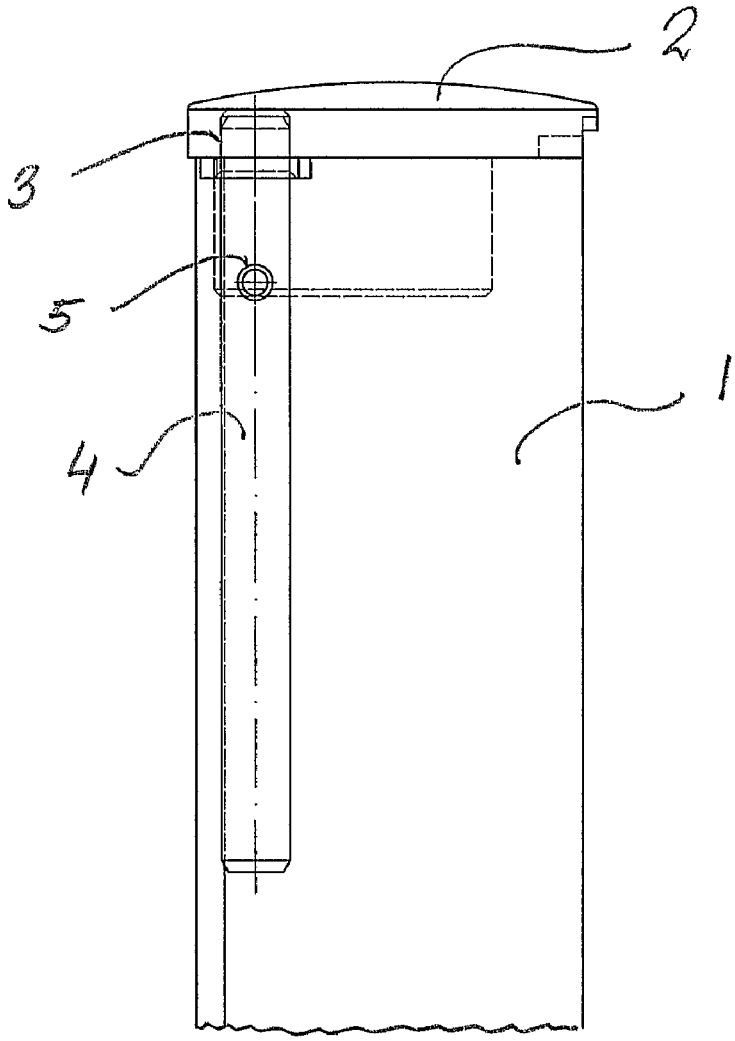
FIG. 1 is a view of an upper hinge section of the arrangement according to the present invention.
Figure 2:
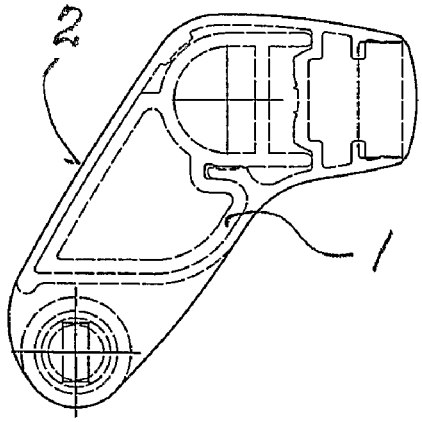
FIG. 2 shows the part illustrated in FIG. 1 from above.

In the different Figures, the same parts carry the same reference numerals. The embodiment of an arrangement according to the present invention illustrated in the Drawings will be described in greater detail in the practical application thereof on a mobile screen of the type which constitutes the subject matter of Swedish Registered Design 69367 which displays a fixed screen on a wheeled frame and two pivotal screens or screen sections on either side of the fixed screen.

Figure 3:
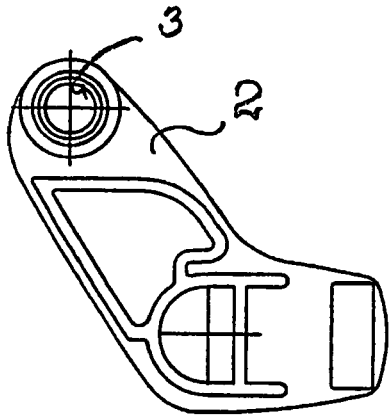
FIG. 3 shows the part illustrated in FIG. 1 from beneath.
Figure 4:
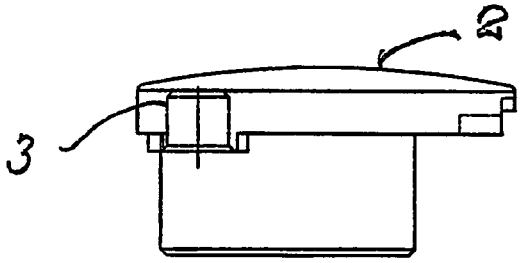
FIG. 4 is a view of an upper portion of the part illustrated in FIG. 1.
Figure 5:
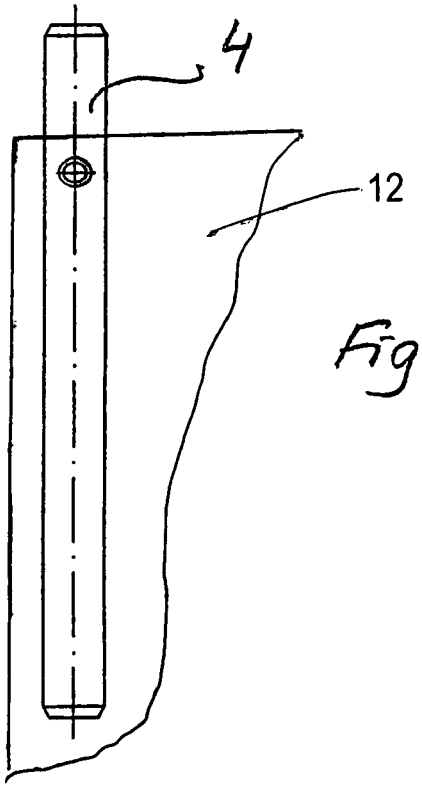
FIG. 5 is a view of a shaft included in the part illustrated in FIG. 1.
Figure 6:
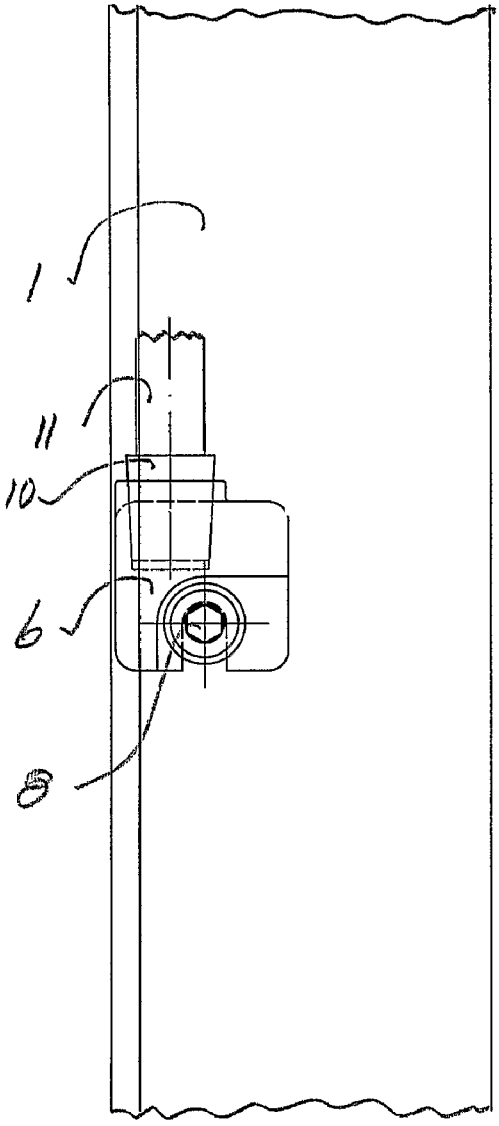
FIG. 6 is a front elevation of a further part of the arrangement according to the present invention.
Figure 7:
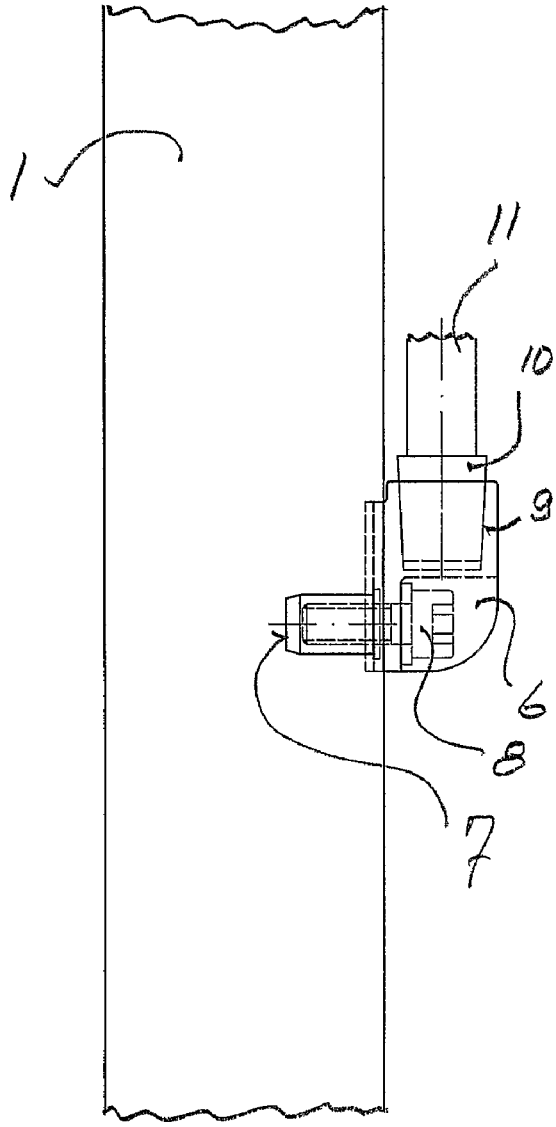
FIG. 7 is a side elevation of the part according to FIG. 6.
Figure 8:
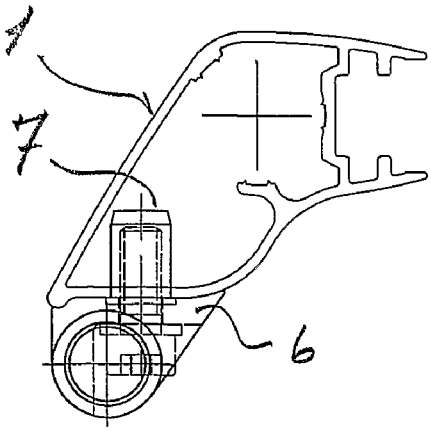
FIG. 8 is a top plan view of the part according to FIG. 6.

The vertical edges of the fixed screen are provided with an aluminum profile 1 which is provided at the top with a plug 2 which appropriately may be manufactured from a plastic material. The plug 2 fits in the profile 1 and closes it upwardly. The plug 2 further has an anchorage 3 for an upper hinge shaft 4 which is cylindrical and fixed in a pivotal screen section 12 by means of a cross pin 5. The plug 2 is shown from beneath in FIG. 3 and from the side in FIG. 4. Further, the hinge shaft 4 is shown in FIG. 5.

The arrangement according to the present invention moreover includes a lower hinge section which is shown in greater detail in FIGS. 6 to 12. In this lower hinge section, there is included a female part 6 which is secured on the profile 1 with the aid of a rivet nut 7 and a screw 8. The female part 6 has an upwardly directed conical hole 9 which is intended for a conical end portion 10 on a shaft 11 which is secured in the movable or pivotal screen section 12.

The female part 6 is shown in greater detail in FIGS. 10 and 11 and the male part 10, 11 is shown in greater detail in FIG. 9. The conicity of the hole 9 and on the end portion 10 may, for example, be 6° but it is naturally possible to select any desired conicity whatever depending on the properties that are desired as regards frictional forces or braking force. The female part 6 may be manufactured from reinforced nylon, but it naturally conceivable to employ many other types of materials, depending on the desired properties of the hinge.

As a result of an arrangement according to the present invention, it is possible to set the pivotal screen sections in any desired position whatever.

Many modifications are naturally possible without departing from the scope of the inventive concept as defined in the appended Claims.

The invention claimed is:

1. An arrangement in a screen for substantially continuous adjustability and parking of the screen in a desired position, comprising:

an upper hinge attached to a pivotal screen section; and a lower hinge attached to the screen, wherein the lower hinge comprises a male part and a female part that cooperate with each other to achieve a braking effect against a pivoting of the pivotal screen section in relation to the screen, wherein the upper hinge comprises a first cylindrical shaft, wherein the male part comprises a second cylindrical shaft secured on the pivotal screen section, and a conical end portion on a distal end of the second cylindrical shaft, the conical end portion having a first conical surface, and wherein the female part comprises a conical hole comprising a second conical surface that cooperates with the first conical surface to provide the braking effect when the conical end portion pivots against the conical hole.

2. The arrangement as claimed in claim 1, wherein the conical hole opens upwardly from the female part toward a center of the pivotal screen section to receive the male part.

3. The arrangement as claimed in claim 1, wherein the male part is mounted on the pivotal screen section, and the female part is mounted on the screen for accommodating at least a part of a weight of the pivotal screen section via the male part for achieving a desired frictional force between the male part and the female part for counteracting the pivoting of the pivotal screen section in relation to the screen.

4. The arrangement as claimed in claim 3, wherein the conical hole is located on a first side of the female part, and the female part is mounted on the screen at a second side located at a right angle to the first side.

5. The arrangement as claimed in claim 4, wherein the second side comprises a screw and a nut that affix the female part to the screen.

6. The arrangement as claimed in claim 4, wherein the conical hole opens outward in a direction from a center of the female part toward the second cylindrical shaft, so that a cross sectional radius of the conical hole at the center of the female part is less than a cross sectional radius of the conical hole at the first side of the female part.

7. The arrangement as claimed in claim 1, wherein the conical end portion tapers in a direction away from the second cylindrical shaft.

8. The arrangement as claimed in claim 1, wherein the conical end portion tapers in a direction opposite the second cylindrical shaft.

9. The arrangement as claimed in claim 1, wherein the female part receives the conical end portion without encasing the second cylindrical shaft.

10. The arrangement as claimed in claim 1, further comprising a cross pin that is adapted to fix the first cylindrical shaft to the pivotal screen section.

11. A hinge device for adjusting a screen, comprising:

an upper hinge section attached to a pivotal screen section; and a lower hinge section attached to a the screen, wherein the upper hinge section is attached to the pivotal screen section via a first cylindrical shaft, and the lower hinge section is attached to a profile located on the screen, wherein the lower hinge section comprises a male part having a second cylindrical shaft secured on the pivotal screen section, and a conical end portion on an end of the second cylindrical shaft, the conical end portion having a first conical surface, wherein the female part comprises a conical hole that opens outward from the female part toward a center of the pivotal screen section to receive the male part, the conical hole having a second conical surface that cooperates with the first conical surface to provides the braking effect when the conical end portion pivots against the conical hole.

12. The hinge device according to claim 11, wherein the male part rests on the female part to accommodate a weight of the pivotal screen section via the male part, so that a frictional force is generated between the first conical surface and the second conical surface to provide the braking effect when the conical end portion pivots against the conical hole.

13. The hinge device according to claim 12, wherein the female part comprises a nylon part.

14. The hinge device according to claim 11, wherein the upper hinge section comprises a plug located on the profile.

15. The hinge device according to claim 14, wherein the plug comprises an anchor adapted to receive the first cylindrical shaft.

16. The hinge device according to claim 11, wherein the first cylindrical shaft is adapted to be attached to the pivotal screen section via a cross pin.

17. A screen system, comprising an upper hinge section attached to a pivotal screen section; and a lower hinge section attached to a screen, wherein the upper hinge section comprises a first cylindrical shaft, wherein the lower hinge section comprises a male part and a female part, the male part comprising a conical means for achieving a braking effect against pivoting the male part and the female part, and wherein the male part comprises a second cylindrical shaft secured on the pivotal screen section, and the conical means is located on a distal end of the second cylindrical shaft, the conical means having a first conical surface, wherein the female part comprises a conical hole comprising a second conical surface that cooperates with the first conical surface to provide the braking effect when the conical means pivots against the conical hole, the conical hole opening outward from the female part toward a center of the pivotal screen section to receive the male part.

18. The apparatus according to claim 17, wherein the conical means tapers in a direction away from the second cylindrical shaft toward the conical hole located opposite from the second cylindrical shaft.

19. The apparatus according to claim 18, wherein the conical hole is located on a first side of the female part, the conical hole receiving the conical means, and wherein the female part comprises a second side opposite the first side, the second side comprising a screw and a rivet nut that affix the female part to a profile.

* * * * *